United States Patent [19]

Tamai et al.

[11] 4,244,290

[45] Jan. 13, 1981

[54] MINIATURE PRINTER

[75] Inventors: Kazuto Tamai; Shigeru Sawada; Osamu Nakamura; Norio Nakagaki, all of Shiojiri, Japan

[73] Assignee: Kabushiki Kaisha Suwa Seikosha, Tokyo, Japan

[21] Appl. No.: 891,416

[22] Filed: Mar. 29, 1978

[51] Int. Cl.[3] ..... B41J 1/48; B41J 7/34; H01F 7/14

[52] U.S. Cl. ..... 101/99; 101/93.22; 400/169; 400/212; 400/216.1; 400/225; 400/569; 400/636; 335/232; 335/234; 335/236

[58] Field of Search ..... 400/157.1–157.3, 400/154.4, 155–155.1, 162.3, 163.1–163.3, 164.5; 101/99, 93.22, 93.29–93.33, 93.48; 335/232–234, 236

[56] References Cited

U.S. PATENT DOCUMENTS

| | | | |
|---|---|---|---|
| 928,582 | 7/1909 | Burlingame | 335/234 |
| 1,552,676 | 9/1925 | Carpenter | 335/234 |
| 2,345,490 | 3/1944 | Martin | 335/234 |
| 2,400,262 | 5/1946 | Quinnell | 335/234 |
| 3,468,246 | 9/1969 | Lee | 101/93.34 |
| 3,872,789 | 3/1975 | Ambrosio | 101/110 |
| 3,928,988 | 12/1975 | Luth | 335/234 |
| 3,950,718 | 4/1976 | Nagamoto | 335/234 |
| 4,104,967 | 8/1978 | Okabe | 101/93.22 |

*Primary Examiner*—Clyde I. Coughenour

*Attorney, Agent, or Firm*—Blum, Kaplan, Friedman, Silberman & Beran

[57] ABSTRACT

A miniature printer includes character rings, each having a series of characters on the outer periphery thereof and teeth on a side surface thereof for selection of a character to be printed. The shaft carrying the character rings also has mounted thereon a radially-slotted disc through the slots of which a light beam is passed for signalling the angular position of said shaft, the light beam being directed at light-detection means. Electronic circuitry controls pawls for selectively stopping the character rings so that a selected character on each ring is brought to rest at a printing position for printing. The electronic circuitry also controls the intermittent feed of printing paper and printing ribbon. A gear-selection mechanism provides for a plurality of printing-paper feed rates as well as for holding the paper stationary when required.

A number of the components are of unitary contruction to increase the ease of assembly and decrease the costs as well as the number of parts. In addition, a number of the parts can be housed in an individual case so that the parts can be handled as a unit.

16 Claims, 28 Drawing Figures

FIG. 8
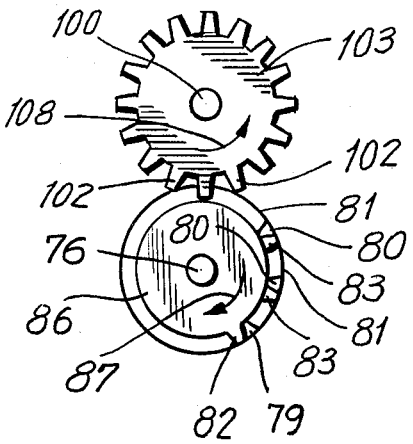
FIG. 10
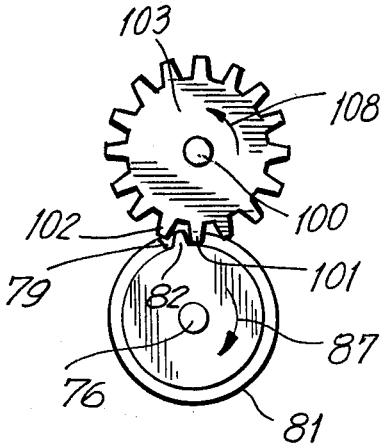
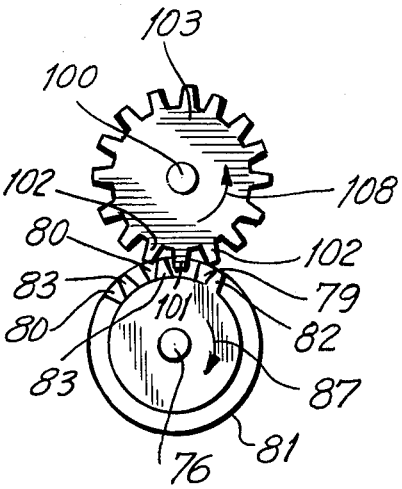
FIG. 14

MINIATURE PRINTER

BACKGROUND OF THE INVENTION

With the development of miniature printers and increasing use in a variety of devices, it has become important to lower the cost of such devices. Such decrease in the cost of miniature printers can best be effected at this time by simplifying the construction, principally by decreasing the number of parts and arranging that the assembly of these parts shall be adaptable to mass production. In addition, it is important to decrease the power needed to operate such a printer as well as to decrease the sound level of such a printer when in operation. These objectives are best achieved by miniaturization of the components. In addition, it is necessary that reliability be increased, particularly with respect to double printing and the formation of so-called dirt. The present invention provides means for achieving these objectives.

SUMMARY OF THE INVENTION

Generally speaking, the present invention utilizes a plurality of character rings releasably mounted on a shaft which can alternately be rotated in one direction and then in the reverse direction. The character rings each have teeth on a side surface thereof for cooperating with a selecting pawl member for bringing the character ring to rest with a selected character at a printing position. After printing is effected by pressing together the character rings and a platen with recording paper and a printing ribbon therebetween, the pawl member is rotated about a shaft to return the character rings from rest position to a standby position.

Mounted on the character ring shaft is a disc having radial slots therein as well as a single wide slot. A light source disposed for passing a light beam through said slots to a detection means thereby generates a series of pulses which are transmitted to electronic circuitry which then activates pawls when the respective character rings are in desired positions for selected characters. The electronic circuitry also controls a rate-selecting mechanism which provides for feeding the web of paper on which printing is carried out at different rates as well as for bringing the paper to a halt. Printing ribbon is also fed across the recording paper as it passes between the character rings and a platen which is brought toward the character rings intermittently for the printing operation. The printing ribbon can be displaced sideways to bring a new portion of the ribbon into operation, this motion making it possible to print in at least two colors where the ribbon is of two colors.

Each pawl member reciprocates around a shaft for engaging and disengaging from a corresponding set of teeth mounted on a side surface of the character ring. The pawl member has two core arms, one of which passes through an electromagnetic coil which is of such a shape that the core arm can occupy either of two stable positions. The core arm is maintained in these positions, in the absence of an electric pulse through the electromagnetic coil, by a permanent magnet. Through the use of the permanent magnet the size of the current through the electromagnetic coil can be decreased while maintaining adequate stability in the positioning of the core arm as well as a strong thrust for transport of the pawl member from the rest position to the engaged position. Not only is the amount of power required thereby decreased, but the size of the unit is also decreased. In addition, the noise generated by the unit is decreased through the decrease in the size of the unit.

Accordingly, an object of the present invention is a miniature printer which can be easily assembled and for which the cost of assembly is low, these objectives being achieved by minimizing the number of parts.

Another object of the present invention is a miniature printer wherein the consumption of electric power is decreased by the use of a permanent magnet as part of a character-selecting mechanism, the cost of the character-selecting mechanism also being reduced.

A further object of the present invention is a miniature printer with uniform and reliable operating characteristics, achieved by suppression of the fluctuation in the force utilized in engaging the character-selecting mechanism with the character rings in the device.

An important object of the present invention is a miniature printer which produces an detects signals which are then provided to an electronic control device for detecting the position of the character rings, the information being used for completion of each printing cycle, the signalling and detecting means including a shutter.

A significant object of the present invention is a miniature printer with an improvement of an electromagnetic coil, electronic components and lead terminals assembled in a compact arrangement on a single printing-base plate.

Yet another object of the present invention is a miniature printer including simple and effective mechanisms for feeding paper at different rates and for feeding a printing ribbon.

Still another object of the present invention is a miniature printer including a paper-feeding mechanism capable of operating at more than one rate as well as capable of locking the paper in a rest position during a printing operation.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 8 is an end view of meshing gears in a first position in a paper-feed mechanism;

FIG. 10 shows the gears of FIG. 8 is a second position;

FIG. 14 shows the gears of FIG. 8 in a third position;

DESCRIPTION OF THE PREFERRED EMBODIMENTS

Figure 1:
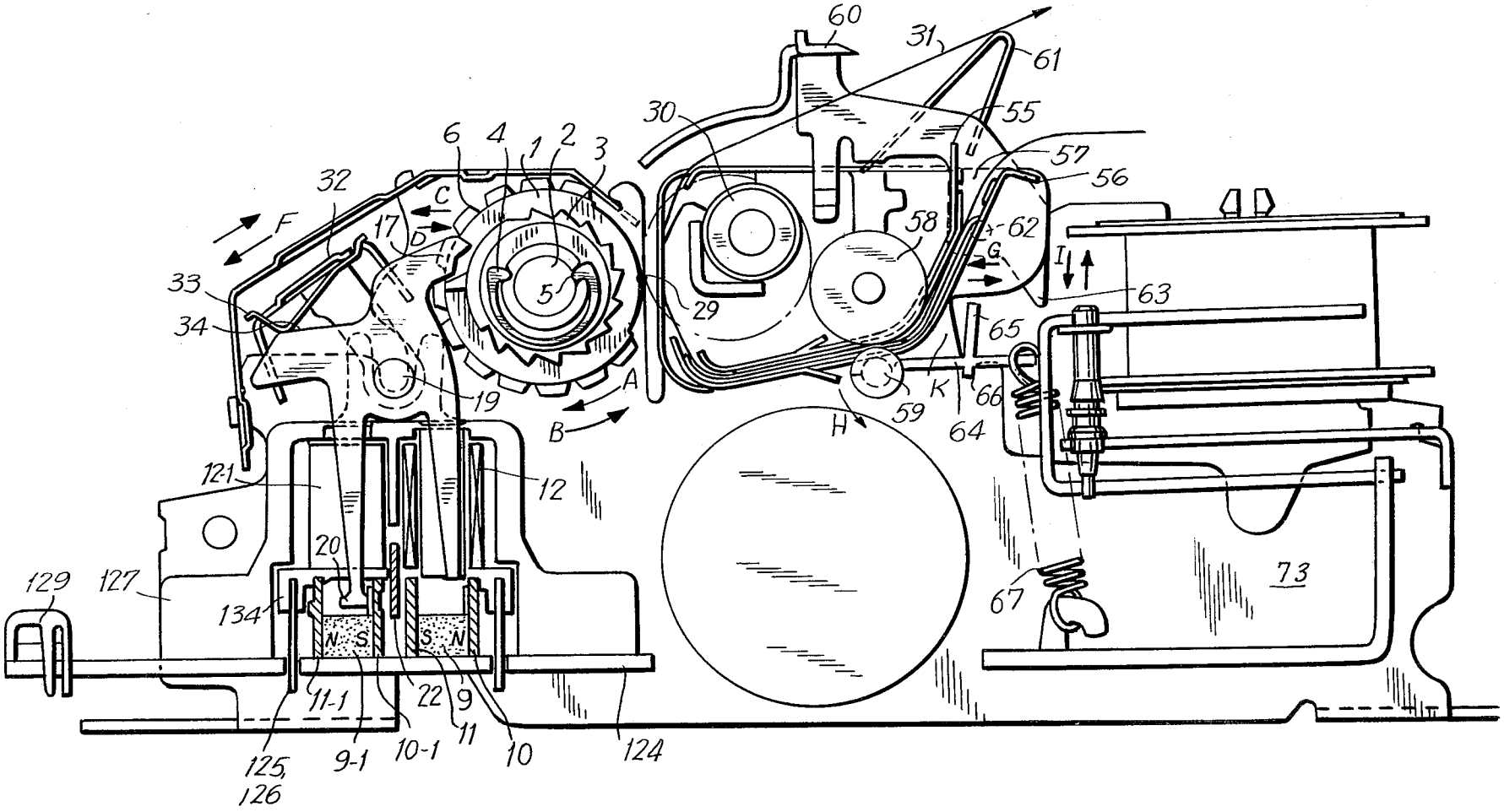
FIG. 1 is an elevational view of the entire printing mechanism.

Referring now to FIG. 1, a plurality of character rings 1 are arrayed on a drive shaft 2, each character ring 1 being independently releasable from drive shaft 2. The outer periphery is divided into a number of positions, in the present case sixteen positions, in twelve of which there are printing characters 6, four of the positions being blank. On the side surface of character ring 1 are twelve ratchet teeth 3, each tooth corresponding to one of the twelve characters. Each character ring is associated with a pawl member 17 engageable with said ratchet. Within each character ring is a spring 4 one end of which falls into a V-shaped recess 5 of drive shaft 2 to hold character ring 1 releasably and drive shaft 2 for rotation together.

Figure 2A:
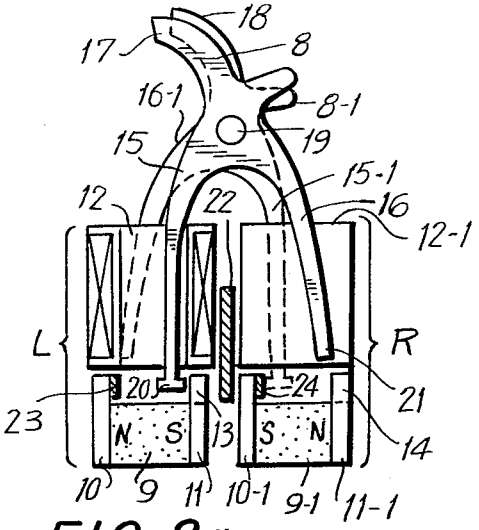
FIGS. 2*a*, 2*b* and 2*c* are, respectively, a side view, a plan view and a partial oblique view of the character-selection mechanism of the present invention.
Figure 2B:
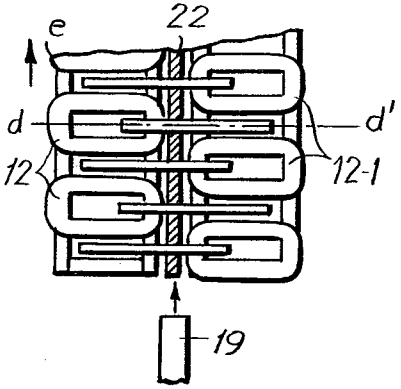
Figure 2C:
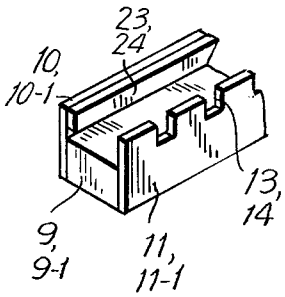

A character-selecting electromagnetic mechanism of which pawl member 17 is a component is shown in detail in FIGS. 2*a*–2*c*. FIG. 2*a* shows two pawl members 17 and 18. The character-selecting mechanism includes a permanent magnet 9 having magnetic pole plates 10 and 11 and an electromagnetic coil 12 as the principal elements. A set of such elements is associated with each pawl member and with a corresponding character ring and ratchet. The elements are arranged in two rows indicated in FIG. 2*a* as L and R respectively. Preferably the R and L units are so arranged that poles of one polarity (shown as S poles in FIG. 2*a*) are adjacent each other. FIG. 2*a* is a sectional view along line d—d' looking in the direction indicated by the arrow e of FIG. 2*b*.

Core member 8 of pawl member 17 has iron core arms 15 and 16, one of which passes through electromagnetic coil 12 and the other of which lies outside said coil. Pawl members 17 and 18 are formed with core members 8 and 8-1, respectively, as one body. Core members, typified by core members 8 and 8-1 are mounted for rotation around shaft 19. Core member 8 protrudes through electromagnetic coil 12 so that end 20 of core arm 15 is positioned within the magnetic field of the unit L formed by the permanent magnet 9 and magnetic pole plates 10 and 11. External core arm 16 coacts with core arm 15 for effective conversion of the magnetic flux produced by the electromagnetic coil 12 into magnetic force. End 21 of external core arm 16 is placed beside an R electromagnetic coil but it is so disposed that the magnetic field produced by permanent magnet 9-1 and magnetic pole plates 10-1 and 11-1 has little effect thereon. Conversely, core member 8-1 which is operated by a corresponding R electromagnetic unit has a core arm 15-1 which lies within electromagnetic coil 12-1 and an external core arm 16-1 which lies beside a L unit. Thus, core members 8 and 8-1, though associated, respectively, with L and R electromagnetic units, function in essentially the same manner except that they are arrayed alternately and the thrust direction for engaging corresponding character ring ratchets is in the same direction. The L and R units are arranged, alternately, in two adjacent rows. Such a multiple arrangement of electromagnetic coils becomes necessary where the number of characters to be printed is large and the distance between such characters is small. Without such an arrangement, namely, if the coil units were all placed in one row, considerable inconvenience with respect to lack of space in an axial direction with respect to the character ring shaft would result. Such inconvenience is eliminated and miniaturization is achieved by the arrangement shown.

Normally, pole pieces are provided with spacers such as 23 and 24 to absorb the shock of collision of core arm 15 or 15-1 with a pole piece. Moreover, such a spacer prevents the force of attraction between the core arm and the pole piece from being so great as to make it difficult to disengage the core arm therefrom. In a preferred embodiment of the present invention, as shown in FIG. 2*c*, at least one pole piece in each unit as indicated by the reference numerals 11 and 11-1 has notches 13 and 14 therein into which end 20 of a core arm can enter and in which it is held by the force of the permanent magnet 9 or 9-1. As is evident, no noise is generated when the core arm end 20 enters the notch, in contrast to the situation when the core arm end is drawn to a pole piece, even when a spacer is present.

Figure 3:
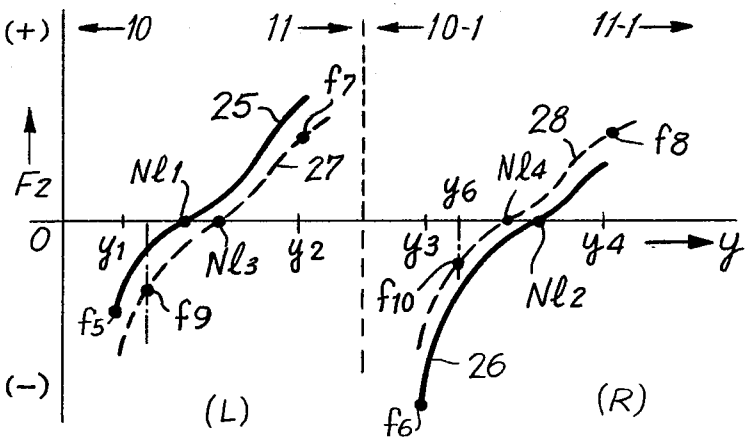
FIG. 3 is a diagram showing the force applied by the electromagnetic means of the character-selection mechanism on a pawl member.

The force exerted by electromagnetic coil 12 and 12-1 and permanent magnets 9 and 9-1 on ends 20 and 21 of core members 8 and 8-1 is given as $F_2$ as a function of position y in FIG. 3 where y is the distance of the core end from the north pole-piece of the corresponding permanent magnet. A force in the right-ward direction (counterclockwise in FIG. 2*a*) is taken as positive, a force in this direction operating when a character is to be selected.

The positions in which the core arms 15 and 15-1, respectively, are attracted and held by magnetic pole plates 10 and 10-1 are indicated in FIG. 3 on the abscissa as $y_1$ and $y_3$, whereas the positions where the pawl has engaged a ratchet tooth correspond to $y_2$ and $y_4$.

Attention is called to member 22 which is inserted between the L and R units in FIG. 2 which acts as a magnetic shield between the electromagnetic units. Solid-line curves 25 and 26 are the characteristic curves for the case where there is no magnetic shield 22 inserted between units L and R as in FIG. 2. From these curves it can be concluded:

1. The forces in the rest states ($y_1$ and $y_3$) are unequal and the neutral points $Nl_1$ and $Nl_4$ do not occur at the same abscissae so that the forces on the core members differ.

2. The difference between the standby force of attraction and the selection-holding force for the left and right units (L and R, respectively) becomes unacceptably great. This can be seen, particularly, for $F_5$ and $F_6$.

3. Not only are the forces different for the standby states and the selection states different, but the forces during transfer of the two core arms are quite different so that the time of transfer differs unacceptably. Also, the minimum operating voltage which will satisfactorily move the core arm from the standby position to the selection position is different for the two sets of coils. Accordingly, enough power must be provided to operate the less efficient coil, thereby increasing the power consumption of the unit.

The performance of the L and R electromagnetic coil units when magnetic shield member 22 is inserted is shown in dashed curves 27 and 28. As can be seen, neutral point $Nl_1$ shifts to $Nl_3$ and neutral point $Nl_2$ shifts to $Nl_4$ whereby the characteristic curves of the L and R units become virtually identical. As a result of this shift the operating voltage of the entire character-selecting mechanism can be lowered and the reliability is greatly increased.

Consideration must be given to the fact that there is leakage of flux between the units. Accordingly, supplementary core arms 16 and 16-1 are provided for prevention of influence of one electromagnetic coil unit on the core arm of another unit. Lacking such supplementary arms, the effect of the leakage flux on an adjacent but non-corresponding core arm can be sufficiently great to cause accidental and unintended selection of a character ring. Using the supplementary core arms as taught herein, such accidental operation is completely eliminated, thereby greatly increasing the reliability of the system. As a further factor in increasing the realibility, the selecting pawl guides 32 (shown in FIG. 1) and shaft 19 are preferably of non-magnetic material. Also, core arms 15 and 16 are formed as a single unit as are pawl members 17 and 18 which are formed with their respective core members as one body, using the same material as in the core member. With attention to these details, influence between neighboring units will be inhibited to the point that reliability becomes completely satisfactory.

It will be understood that the selection holding forces $f_7$ and $f_8$ of the curves 27 and 28 tend to saturate as the core arms 15 and 15-1 approach magnetic pole plates 11 and 11-1 on the selection side. For this reason, as indicated above, the magnetic pole plates 11 and 11-1 are preferably provided with notch portions 13 and 14 as shown in FIG. 2*c* whereby the selection-holding forces are inhibited from increasing suddenly as the core arm approaches the corresponding magnetic pole plate. This construction is sufficiently simple so as to permit space for reset mechanism to be provided, the reset mechanism coming into play when the selection stroke is to be terminated. Moreover, since the position of the core member at the end of the selection stroke is determined by the pawl of the core member 8 or 8-1 as it engages with the character ring 1 ratchet and the position of the tooth bottom, the printing position can be set very precisely. Moreover, the undesired action of the core member 8 or 8-1 disengaging from the character ring by rebound is completely eliminated, once more increasing the reliability of the system. It should be noted that the gaps in the pole plates 13 and 14 shown as notches need not be in this form. Apertures or slots or other types of shapes for the cuts may also be used. In addition, pole plates 10 and 10-1 may also be provided with such notches or apertures so that the spacers 23 and 24 at the standby position may be eliminated.

The operating time for each unit is taken to start at the initiation of current flow through the magnetic coils 12 or 12-1 up to engagement of the pawl members 17 or 18 with the ratchet 3. This operating time is strongly influenced by the attractive force of the pole plate in the standby condition. The positions of the ends of the core arms when spacers 23 and 24 are present are shown as $y_5$ and $y_6$ respectively. The standby attractive force is then $f_9$ and $f_{10}$ for the left and right units. The weaker this standby attractive force, the greater is the velocity with which the core arm moves from standby position to selection position for a given current in the corresponding electromagnetic coil. Also, as a consequence, weakening of the standby force shortens the time required for the selection step. Furthermore, since the selection-holding forces $f_7$ and $f_8$ are preferably as large as possible with the objective of shortening the operating time, permanent magnets 9 and 9-1 should preferably be of high magnetic flux density. Accordingly, ferrite magnets are preferably used.

Standby attractive force can be decreased by the following methods:

1. Make the thickness of the spacers 23 and 24 as great as is commensurate with the minimum acceptable standby force.

2. With respect to core arm 15 or 15-1, decrease the area of the end which opposes the magnetic pole plate 10 or 10-1 at the standby position.

3. Provide the notched portion or apertures as indicated above in magnetic pole plate 10 or 10-1.

The operation of the electromagnetic unit in the selection of characters will be explained in connection with FIG. 1. At the beginning of a printing cycle, character ring 1 rotates with drive shaft 2 in the direction indicated by the arrow having the reference character B. A desired character 6 on character ring 1 reaches printing position 29, and, synchronous therewith (with an appropriate lead time) current is passed through electromagnetic coil 12. End part 20 of pawl member 17 will initially be unpolarized, in the absence of current through the coil, and so will be held to be adjacent pole plate in the standby position, assumed here to be a south pole. Current is passed through electromagnetic coil 12-1 in such a direction as to induce the same polarity in end part 20 as in pole plate 10-1, thereby generating a force of repulsion urging the core arm toward pole plate 11-1 which becomes a north pole, exerting an attractive force on end 20. These forces respectively serve to rotate pawl member 17 clockwise, that is, in the direction of arrow D causing engagement of pawl member 17 with ratchet 3 and bringing character ring 1 to rest. With proper synchronization, each ring is selectively brought to rest at a desired character or blank space. After desired character 6 on each ring has been brought into printing position 29, a platen 30 is pressed against the row of character rings and characters thereon to imprint said characters on a web of paper 31. At completion of the printing operation, a cam (not shown) makes contact with the end of selecting pawl guide 32 so that said pawl guide 32 turns counterclockwise or in the F arrow direction whereby the pawl member 17 receives a force on its reset portion 34 in the C arrow direction through a reset spring 33 to disengage the pawl from the ratchet 3 and move pawl member 17 from the selection position to the standby position. The length of the electromagnetic coil pulse is such that it is terminated on or before the time at which the pawl member is to be disengaged from the ratchet. Accordingly, end part 20 of the pawl member 17 will be held once more in the standby position by the appropriate magnetic pole plate.

Since the various character rings must be brought to different positions, that is, must rotate through different angles to reach desired printing positions, rotation of the shaft cannot be terminated when the first character ring reaches printing position. Accordingly, it is necessary to provide a slip mechanism so that the drive shaft 2 can continue to rotate until the last character ring reaches printing position. For this reason, a spring mechanism consisting of a spring 4 having projecting ends which slip into notches 5 must be provided, this arrangement makes it possible for the character rings to be held releasably on drive shaft 2. At the completion of the printing operation, the drive shaft 2 is rotated in the reverse direction, namely that indicated by the arrow A in order to bring the character rings to standby condition. As the drive shaft 2 rotates in the reverse direction, spring 4 enters the V-shaped recess 5 of drive shaft 2 once more, and the drive shaft 2 and the character rings 1 rotate as one solid piece until they are brought to rest at the standby position.

Figure 4B:
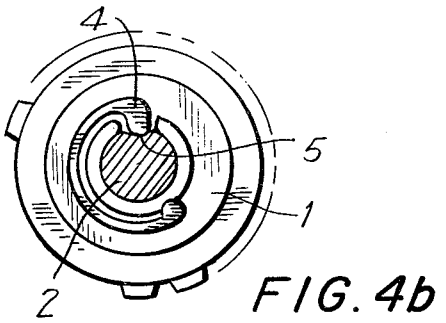
FIGS. 4*a*, 4*b*, 4*c*, 4*d* and 4*e* are, respectively, an embodiment of the character-selection-detecting mechanism of the present invention, a side view in partial section of a character ring, a side view which is a portion of the detecting mechanism, an oblique view of a shutter of said detecting mechanism and a timing chart.
Figure 4C:
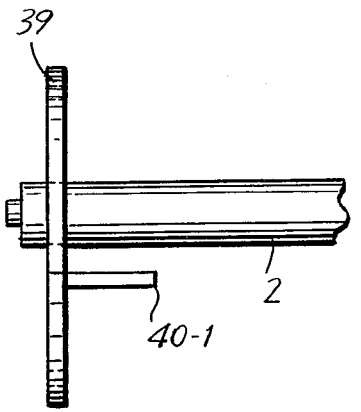
Figure 4E:
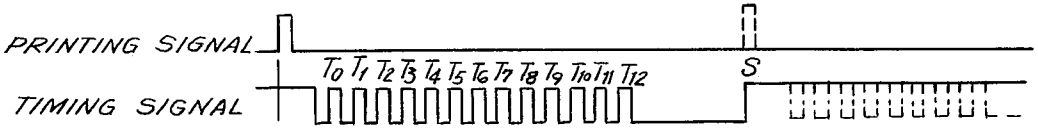
Figure 4A:
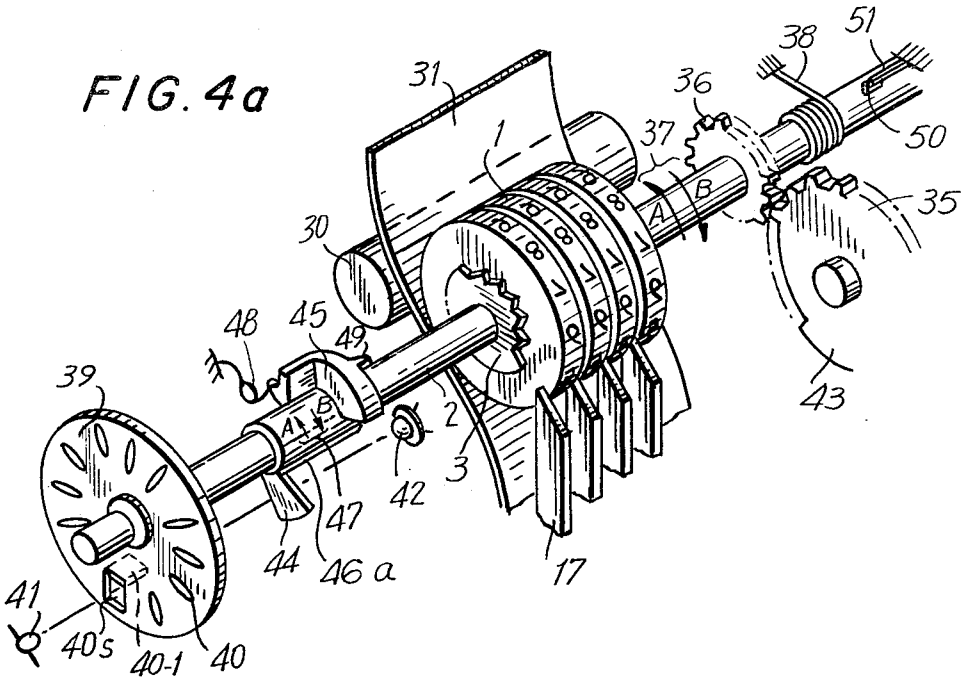
Figure 4D:
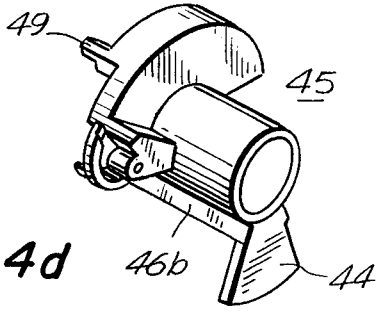

The character selection mechanism of the printer requires that the angular position of the drive shaft, and thus, of the character rings, be known at all times. An embodiment of such a mechanism is shown in FIG. 4*a* in which an intermittent drive gear 35 meshes with intermittent gear 36 on drive shaft 2. As gear 36 rotates in the 37B direction it winds up coil spring 38. Character ring 1 simultaneously rotates in the same direction toward printing position and slotted plate 39 also rotates with drive shaft 2. Accordingly, slotted plate 39 serves as a detecting plate since it is synchronous with drive shaft 2 as well as character rings 1. Each of the slits 40 on detecting plate 39 corresponds to a character position; broad slit 40*s* has no connection with a character position, but, instead, serves to locate the standby position.

A luminous element 41 which may be a light-emitting diode cooperates with a light-receiving element 42, such as a photo-transistor, the light from the light source travelling through the slots in detecting plate 39, for selectively bringing the character ring 1 to rest by providing for passage of current through the corresponding electromagnetic coil and engagement of the corresponding ratchet. After selection of the character from the character ring 1 is completed, the meshing of intermittent drive gear 35 and intermittent driven gear 36 is terminated. Intermittent gear 36 is then held firmly in position by the untoothed portion 33 of the intermittent drive gear 35 with coil spring 38 fully wound up. At this point, the platen 30 is in synchronous rotation with the intermittent drive gear 35. The platen 30 makes contact with the character selected by pressing the recording paper 31 thereagainst for printing. Immediately after printing is completed, a projection 40-1 which is disposed proximate broad slit 40-*s* becomes engaged with a face 46*a* of a shutter device 45 forcing it to turn in the direction of arrow 47B. Shutter device 45 has a shutter 44, together with a frame (not shown) and is connected to a spring member 48. A stop 49 on shutter device 45 is held securely against said frame by action of spring member 48 thereby interrupting the beam from luminous element 41 to light receptor 42.

When intermittent gear 36 is released by the action of the notches portion of intermittent drive gear 35, character rings 1, intermittent gear 36 and detecting plate 39 revolve in the 37A direction and return to standby position under the drive of coil spring 38. Projection 40-1 then makes contact with face 46B of the shutter device 45, carrying shutter 44, and forces it to turn in the direction indicated by the arrow 47A. Since the frame and shutter device 45 are connected with spring member 48, stop 49 on the shutter device 45 is securely forced against the frame by action of said spring member 48, thereby permitting the light beam passing through the slotted plate 39 to reach the receptor 42, and the drive shaft with its character rings and the detector plate returns to the standby position. A paper-feeding mechanism is then brought into operation at the completion of the printing step.

Drive shaft 2 has thereon a ridge 50 so positioned that it may strike against stop 51 which is securely fixed to the frame of the device. Under certain circumstances, there may tend to be a rebound and reversal of direction of the rotation of the shaft as a result of this striking together of ridge 50 and stop 51. Also, rotation of the shaft produces reference pulses S and T which serve as timing signals for operation of the selecting pawls. A rebound of the shaft by the sequence of events indicated above may cause the disappearance of the reference signal S and the character signal $T_0$. For this reason, a distance is provided between the standby position and the character signal $T_0$ by making the slot 40-*s* of a large width, thus preventing the generation of noise.

Figure 5B:
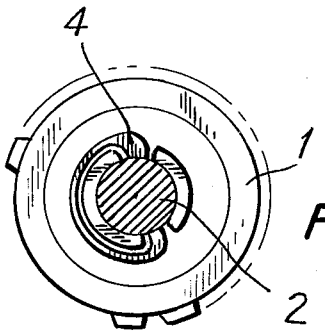
FIGS. 5*a*, 5*b* and 5*c* are respectively another embodiment of a character-selection detection mechanism, a side view in partial section of a character ring and a timing chart.
Figure 5A:
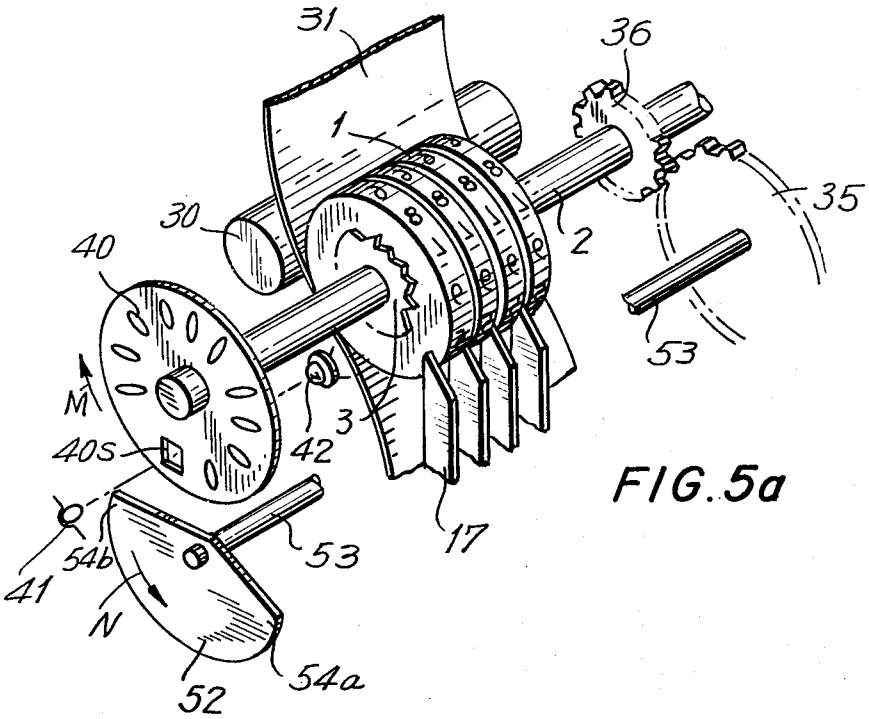
Figure 5C:
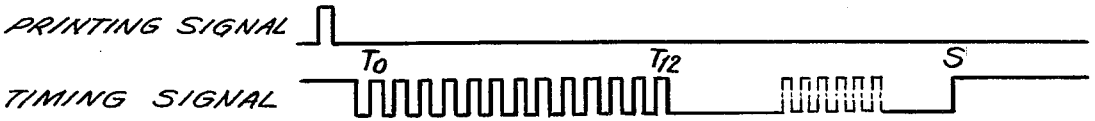

Another embodiment of the invention is shown in FIGS. 5*a*, 5*b* and 5*c* in which the rotary force of the drive shaft is transmitted to the character ring 1 by friction with spring 4, thus eliminating the need for recess 5 (as shown in FIG. 1) through which the spring 4 is engaged with drive shaft 2. In the present embodiment, it is necessary for the drive shaft 2 to turn twice in a single printing cycle. A leaf spring is used for spring 4 and the energy loss necessary to wind up a coil spring (the coil spring 38 of FIG. 4*a*) is eliminated. Since the drive shaft 2 turns twice in a single printing cycle, a shutter device 52 is necessary for eliminating the signal on the return portion of the printing cycle. The intermittent drive gear 35 is arranged to rotate once while the intermittent driven gear 36 rotates twice. Shutter device 52 which is rotatably supported on shaft 53 which also carries intermittent drive gear 35 is positioned out of the optical axis of luminous element 41 and receptor 42 when the character-ring mechanism is in the standby state. When intermittent gears 35 and 36 mesh, detecting plate 39 turns in the arrow M direction and shutter device 52 turns in the arrow N direction. Slits 40 on detecting plate 39 provide for engagement of the pawl member 17 for selectively bringing the character ring to a stop at the desired character position. With all the character rings in the printing position, platen 30 presses against recording paper 31 to effect printing. During the printing operation, intermittent drive gear 35 rotates with its untoothed part (not shown) making contact with intermittent gear 36. At the completion of printing, margin 54*a* of shutter device 52 rotates to interrupt the light beam between emitter 41 and receptor 42. Then, concurrently with the passage of the last slit 40 through the optical axis, margin 54*b* of shutter device 52 is removed from the optical axis between elements 41 and 42 and, once more, a beam passes therebetween so that a reference signal is produced as shown in FIG. 5*c*, a printing cycle thus coming to an end. The same cycle is then repeated to continue operation of the printer.

Figure 6A:
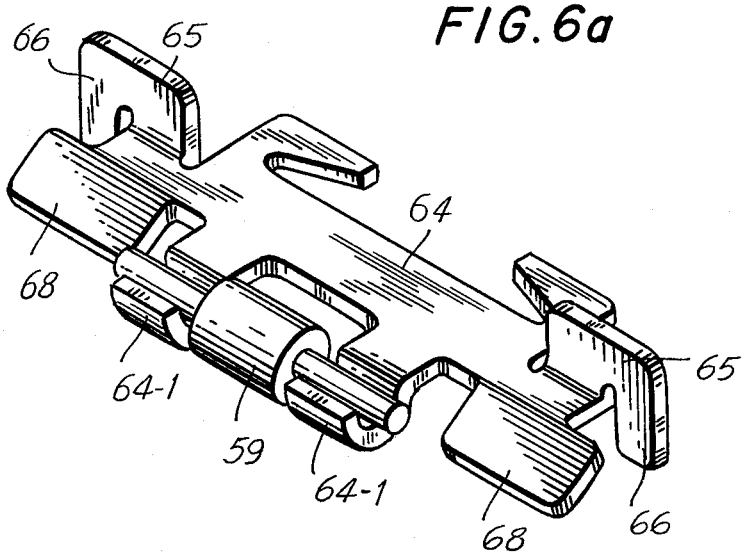
FIGS. 6*a* and 6*b* are respectively an oblique view and a front view in partial section of a portion of a paper-holding mechanism in accordance with the present invention.
Figure 6B:
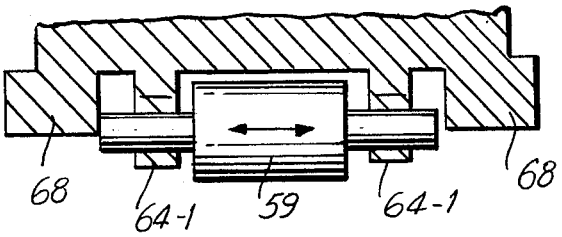

The operation of the paper-feeding and release mechanism is presented with reference to FIGS. 1 and 6*a* and 6*b*. Recording paper 31 is introduced through a V-shaped gap 57 between paper guides (inside) 55 and (outside) 56, and is then fed between a paper-feeding roller 58 and an idler roller 59 after which the web of paper passes between platen 30 and character rings 1 where printing occurs and then makes its way out between a paper-cutting lever 60 and platen cover 61. The paper is driven by friction with paper-feeding roller 58 which rotates intermittently. Idler roller 59 turns as a follower at a constant pressure in engagement with paper-feeding roller 58. To release the recording paper 31, the paper cutting lever 60 is made to pivot on a shaft 62 as a fulcrum in the arrow I direction; then a lower end part 63 of the paper-cutting lever 60 permits both ends 65 of an idler lever 64 to turn in the direction of the arrow G using fulcrum 66 as a center, and makes idler lever 64 stop being forced against stopper K of the frame 73. Idler roller 59 being held under idler lever 64 sinks in the arrow H direction away from paper-feeding roller 58 and frees the recording paper 31. By releasing the paper cutter 60 from hold, the idler lever 64 returns to its original position under the bias of the spring 67 and the idler roller 59 is also reset to its original state of engagement.

In earlier constructions, idler lever 64 for supporting idler roller 59 has been composed of an idler lever shaft and an idler lever in separate units. Constructing idler lever 64 in one body by eliminating the idler lever shaft and providing portion 66 for supporting on the frame has made it possible to reduce the quantity of component parts and simplified the construction.

Lubrication is necessary to facilitate smooth rotation of idler roller 59 on the supporting lips 64-1. In the past it was usual that lubricating oil was conveyed to the surface of idler roller 59 resulting in oil stains on the recording paper 31 because of the lack of a stop 68 which is provided in the present embodiment for controlling the motion of idler roller 59 in the axially right and left directions. Stop 68 prevents idler roller 59 from moving in either of the directions indicated by the double-headed arrow thereby preventing any possible occurrence of oil stain on the web of recording paper.

Figure 7:
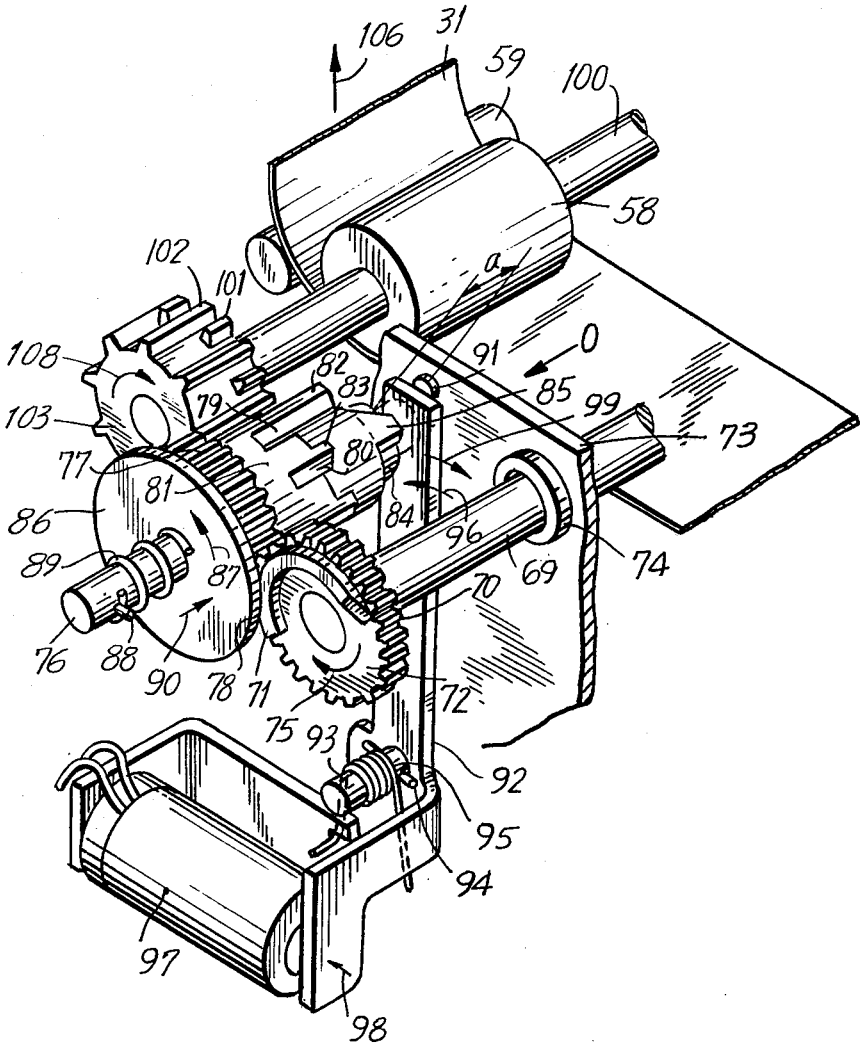
FIG. 7 is an oblique view of a paper-feeding mechanism in accordance with the present invention.
Figure 9:
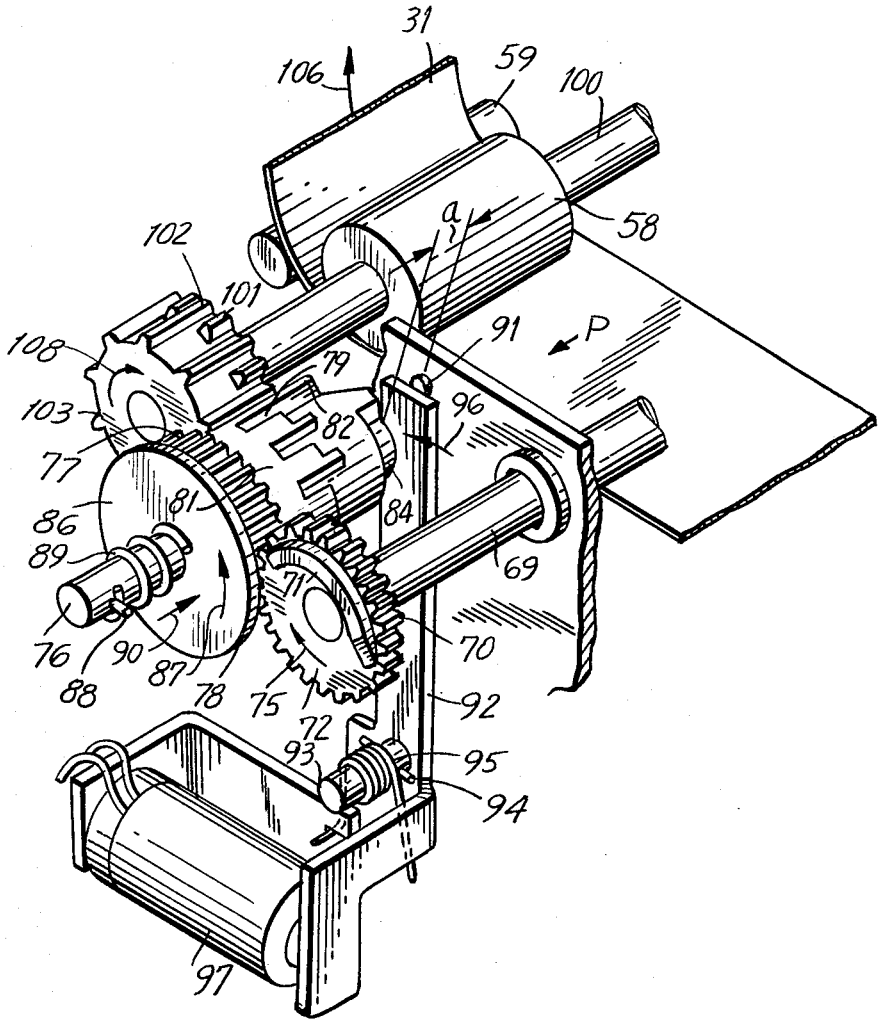
FIG. 9 is an oblique view of said paper feed mechanism including a feed-rate selection mechanism.

The paper-feeding mechanism is described in FIGS. 7 through 17. As shown in FIG. 7, power shaft 69 is mounted on power wheel 72 for rotation therewith, power wheel 72 including both a toothed portion 70 and a semi-circular return cam portion 71. Power shaft 69 is supported in a bearing 74 firmly fixed on frame 73 and is driven in the arrow 75 direction by a motor (not shown). Driving wheel 86 has a toothed portion 77 disposed for meshing with toothed portion 70 of power wheel 72 and also has a disc portion 78 having a larger diameter than that of the toothed portion, said disc portion 78 engaging with return cam 71. Driving wheel 86 also has a cylindrical cam portion 81 provided with tooth-recess portions 79 and 80 on part of its circumference, a regular paper-feeding tooth 82 on the outer part of the circumference adjacent the tooth recess portion 79, a rapid paper-feeding tooth 83 on part of the circumference adjacent the tooth recess portion 80 and a differential cam 85 fitted on a cylindrical bearing surface 84. Driving wheel 86, hereinafter also referred to as driving gear 86 with special reference to the toothed portion 77 thereof, is mounted on drive shaft 76 for rotation therewith, the join therebetween being such that said driving wheel is permitted limited axial motion relative to said drive shaft 76.

Driving wheel 86 is turned by power wheel 72 in arrow 87 direction and disc portion thereof is subjected to a force in the arrow 90 direction by means of coil spring 89 supported by a pin 88 securely fixed on drive shaft 76, whereby a face of cylindrical portion 86 is held firmly against return cam 71. When return cam 71 makes contact with the face of disc portion 78, an axial space is provided between end portion 84 of driven wheel 86 and a projection 91 on frame 73. A rate-selection lever 92 is rotatably mounted on a shaft 93, said rate-selection lever 92 being brought to rest in the thrust direction by a pin 94. Said rate-selection lever 94 is so mounted that it can be rotated around shaft 93 and introduced into space "a". The lever is subjected to a force in the arrow 96 direction by means of a spring 95 mounted on shaft 93. When sufficient voltage is applied to electromagnet 97, rate-selection lever 92 is rotated in arrow 99 direction under an attractive force as indicated by arrow 98. Opening "a" is arranged to be greater than the thickness of rate-selection lever 92 for smooth execution of the rotary movement of said rate-selection lever. Affixed to rotating shaft 100 is a driven wheel or gear 103 which has arranged on its circumference alternately paper-feeding teeth 101 which mesh with regular paper-feeding teeth 82 on driving gear 86 for the regular feeding of paper and which mesh with both the regular paper-feeding teeth 82 and rapid paper-feeding teeth 83 to provide for rapid feeding of paper. Also, supplementary teeth 102 are provided for meshing with tooth-recess portion 79 for regular paper-feeding and which mesh with tooth recess portions 79 and 80 for the case of rapid paper-feeding and which come only lightly in touch with the peripheral diameter of the cylindrical cam portion 81 of driving wheel 86 after paper-feeding is finished and the feeding of the paper is to be stopped. Also affixed to rotating shaft 100 is paper-feeding roller 58 which conveys paper web 31 in the arrow 106 direction by friction in combination with idler roller 59 pressed against same.

FIG. 8 is pertinent to the motion of wheels 86 and 103 under the condition that the paper feeding is stopped, FIG. 8 showing said wheels as viewed from the arrow O direction shown in FIG. 7. Since the supplementary tooth 102 is only lightly in touch with cylindrical cam portion 81, driven wheel 103 is then securely locked in stationary position until succeeding paper-feeding is initiated even if the driving wheel 86 turns in arrow 87 direction after meshing of the regular paper-feeding teeth 82 or rapid paper-feeding teeth 83 with the paper-feeding teeth 101 and meshing of the tooth-recess portion 79 or 80 with the supplementary teeth 102 are completed, thus terminating the feeding of paper. When driven wheel 103 is held stationary, paper-feeding roller 58 ceases rotation. Consequently, the feed of the paper is completely controlled so that the pitch distance between printing lines is completely uniform. The regular feeding of paper is exemplified in FIG. 9. No current is passed through electromagnet 97 so that rate-selection lever 92 maintains contact with drive shaft 76 through opening "a" under the action of spring 95. Power wheel 72 continues to rotate in the arrow 75 direction and when return cam 71 and disc portion 78 no longer engage each other, driving wheel 86 initiates an axial motion in the thrust direction indicated by arrow 90 under the influence of coil spring 89 and end portion 84 of driving wheel 86 is held from making contact with projection 91 by rate-selection lever 92. Consequently, only the regular paper-feeding teeth 82 can mesh with the paper-feeding teeth 101. The meshing motion in this configuration, as viewed from the direction of arrow P is shown in FIG. 10.

As the regular paper-feeding teeth 82, turning in arrow direction 87, mesh with paper-feeding teeth 101, the supplementary teeth 102 also engage with tooth-recess portion 79 so that the driven wheel 103 rotates smoothly in the arrow 108 direction. As it turns further, the supplementary teeth 102 are secured under lock by the cylindrical cam 81 thereby stopping the rotation of driven wheel 103. Thus, the web of paper 31 (shown in FIG. 9) is conveyed and halted intermittently by the regular paper-feeding teeth 82.

Figure 12:
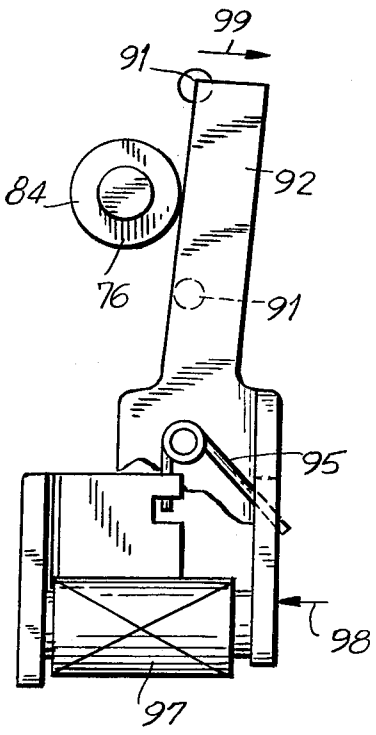
FIG. 12 shows the arrangement of a rate-selection lever for controlling the feed rate of paper.
Figure 11:
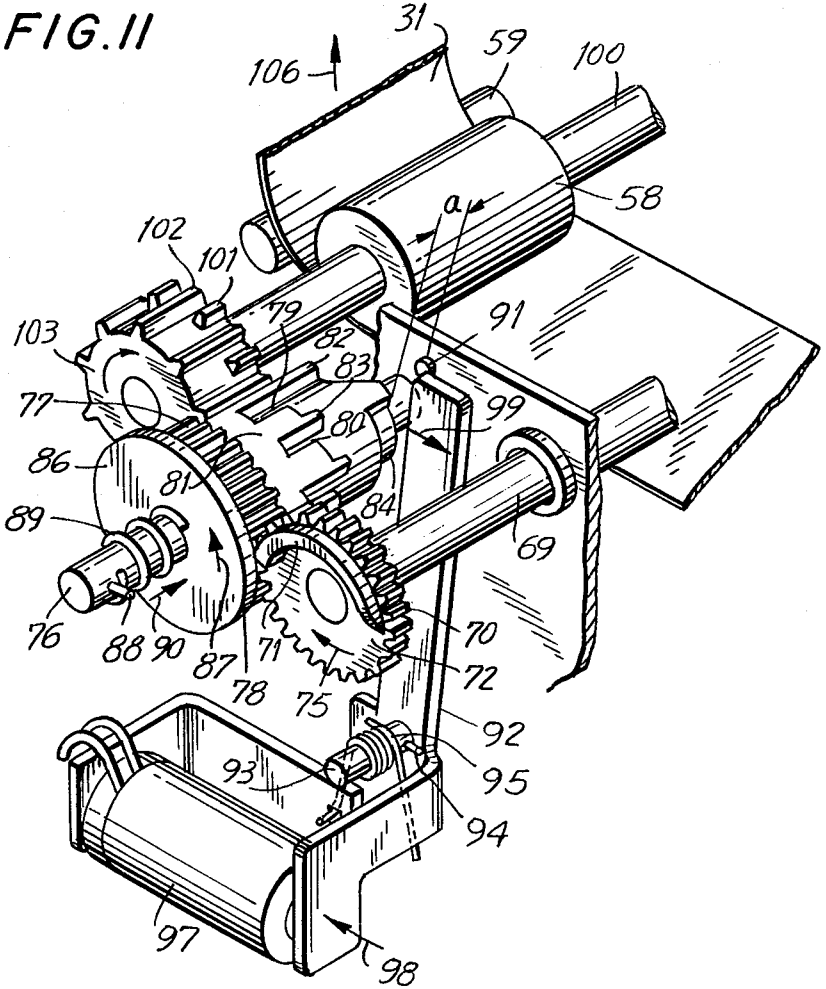
FIG. 11 shows the paper-feed mechanism of FIG. 7 at the inception of rapid paper-feeding.
Figure 13:
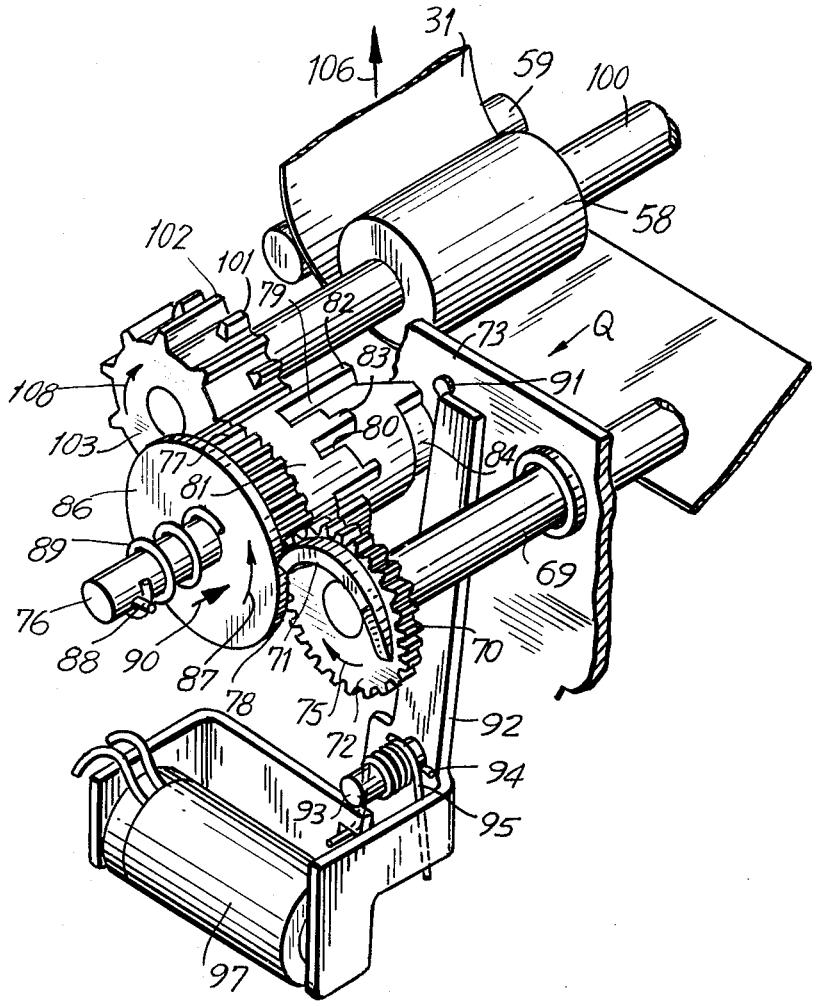
FIG. 13 is an oblique view of the paper-feeding mechanism showing the axial movement of a driving gear on its shaft.

FIGS. 11 and 13 show the configurations in which rapid feeding is effected and FIG. 12 shows the effect of the electromagnet 97 on the rate-selection lever 92. Rate-selection lever 92 is rotated outside the peripheral surface of end portion 84 and from opening "a" in the arrow 98 direction under the attractive force of the electromagnet 97 when a pulse of current is put therethrough. When rate-selection lever 92 is removed from opening "a" and when the disc portion 78 and return cam 71 are released from engagement as in FIG. 13, driving wheel 86 slides in the thrust direction as indicated by the arrow 90 under the influence of coil spring 89, and end portion 84 comes into abutment with frame 73, in which configuration the paper-feeding teeth 82 and the rapid paper-feeding teeth 83 are at positions such that they can mesh with paper-feeding teeth 101. The meshing movement at this moment as viewed from the arrow direction Q is shown in FIG. 14. In a manner similar to that explained in connection with FIG. 10, driven wheel 103 starts rotating in arrow 108 direction as the regular paper-feeding teeth 82 mesh with the paper-feeding teeth 101; then, tooth recess portion 79 and the supplementary teeth 102 mesh with each other, and the rapid paper-feeding teeth 83 mesh with succeeding paper-feeding teeth 101 and, in turn, tooth-recess portion 80 meshes with succeeding supplementary teeth 102. Then driven wheel 103 is made to rotate further in the arrow 108 direction and enters into the position in which it is secured under lock. In other words, by the meshing interaction of the rapid paper-feeding teeth 83 and the paper feeding teeth 101, the rotation ratio of driven wheel 103 and driving wheel 86 takes on a different value for the rapid paper-feeding teeth 83, thus providing for quick feeding of the web of paper 31. Moreover, supplementary teeth 102 only lightly touch cylindrical cam 81 and are moved in sliding motion while being secured under lock against rotation when the driving wheel 86 is moved axially in the thrust direction as indicated by arrow 90. It is thus made certain that the paper-feeding roller 58 will perform effectively and will completely avoid irregular pitch during the halting of the feed.

Figure 15:
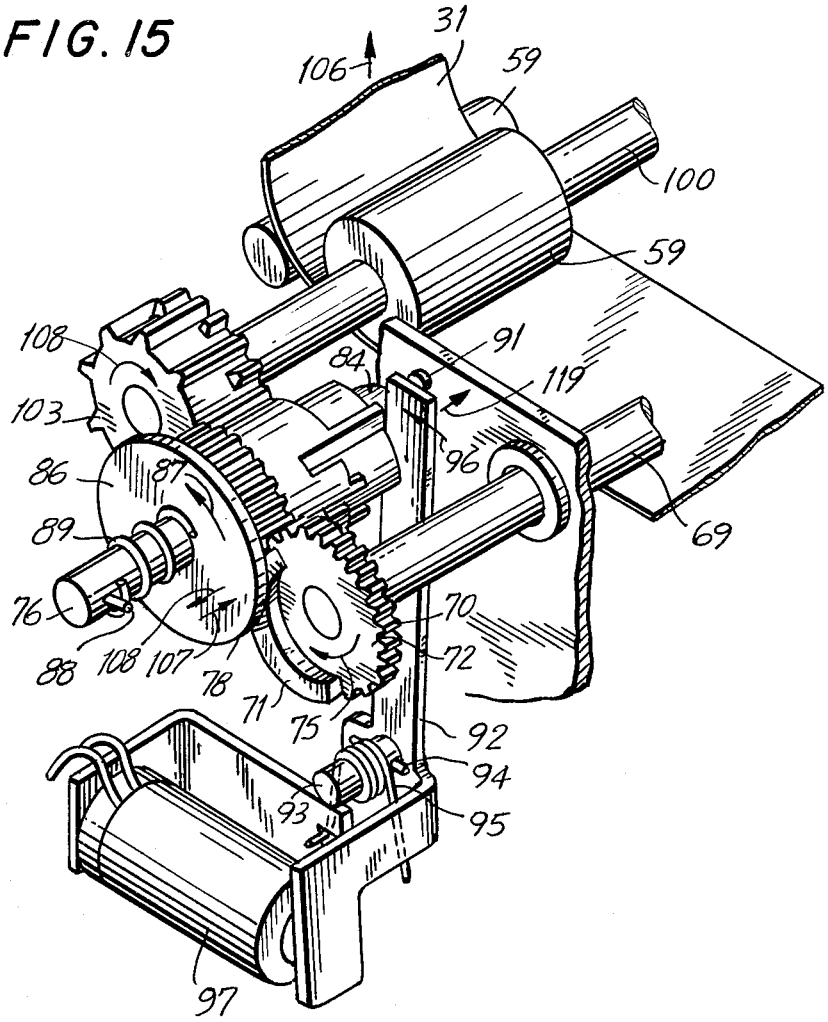
FIG. 15 shows the arrangement of the gears in the paper-feed mechanism at the inception of the return movement of the driving gear.
Figure 16:
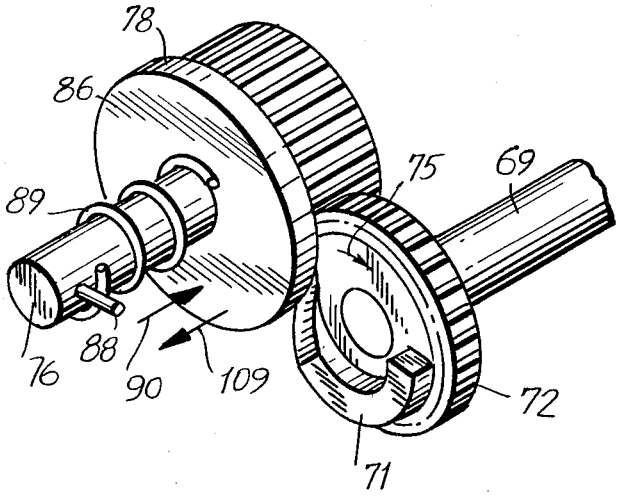
FIG. 16 illustrates cam action between a power gear and a drive gear in the rate-selection mechanism.
Figure 17:
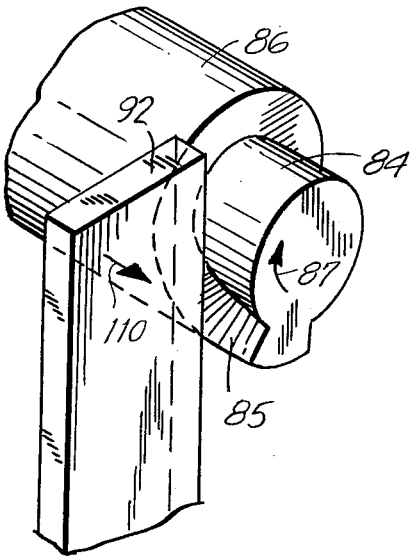
FIG. 17 shows the relationship of the rate-selection lever to the drive gear.

The return motion of driving wheel 87 is described in connection with FIGS. 15, 16 and 17. In FIG. 15, electromagnet 97 is shown at the completion of rapid paper-feeding, a condition in which no current flows through the electromagnet. The rate-selection lever 92 engages the cylindrical face of end portion 84 under the action of spring 95. Then, as shown in FIG. 16, when power wheel 72 rotates in the arrow 75 direction, return cam 71 pushes against disc portion 78 to overcome the force of coil spring 89 in the arrow 90 direction, and driving wheel 86 is moved in the arrow 109 direction, returning it to its original position. End portion 84 is separated from projection 91, generating opening "a". As driving wheel 86 stafts its return under the action of return cam 71, as shown in FIG. 17, the rate-selection lever 92 is pushed away from the cylindrical surface of end-portion 84 in the arrow 110 direction by differential cam 85 and returns to the end face of end portion 84, and, simultaneously, rate-selection lever 92 enters opening "a" again and presses against drive shaft 76 by the force exerted by spring 95 in the arrow 96 direction.

With driving wheel 86 returned to its original position against the thrust of coil spring 89, only the regular paper-feeding teeth 82 can mesh with paper-feeding teeth 101 as shown in FIG. 7.

As indicated above, regular feeding of paper is performed by means of the regular paper-feeding teeth 82, and, when rapid feeding of the paper is required, the driving wheel 86 is moved axially in the thrust direction 90 by the coil spring 89, rate-selection lever 92 and electromagnet 97, and rapid paper-feeding tooth 83 is made to mesh with paper-feeding tooth 101, thereby altering the rotation ratio of driven wheel 103 and driving wheel 86, so that both regular feeding and rapid feeding of paper are achieved with ease. In addition, since the driving wheel 103 and driving wheel 86 interact in the engagement of the gear teeth, very little driving noise is generated and the construction can be simplified. These factors lead to easy accomplishment of precision of parts, a decreased quantity of component parts, easy assembling of the apparatus, miniturization and saving of power as well as reduction of cost. As a result, the advantages deriving from this construction are great.

Figure 18:
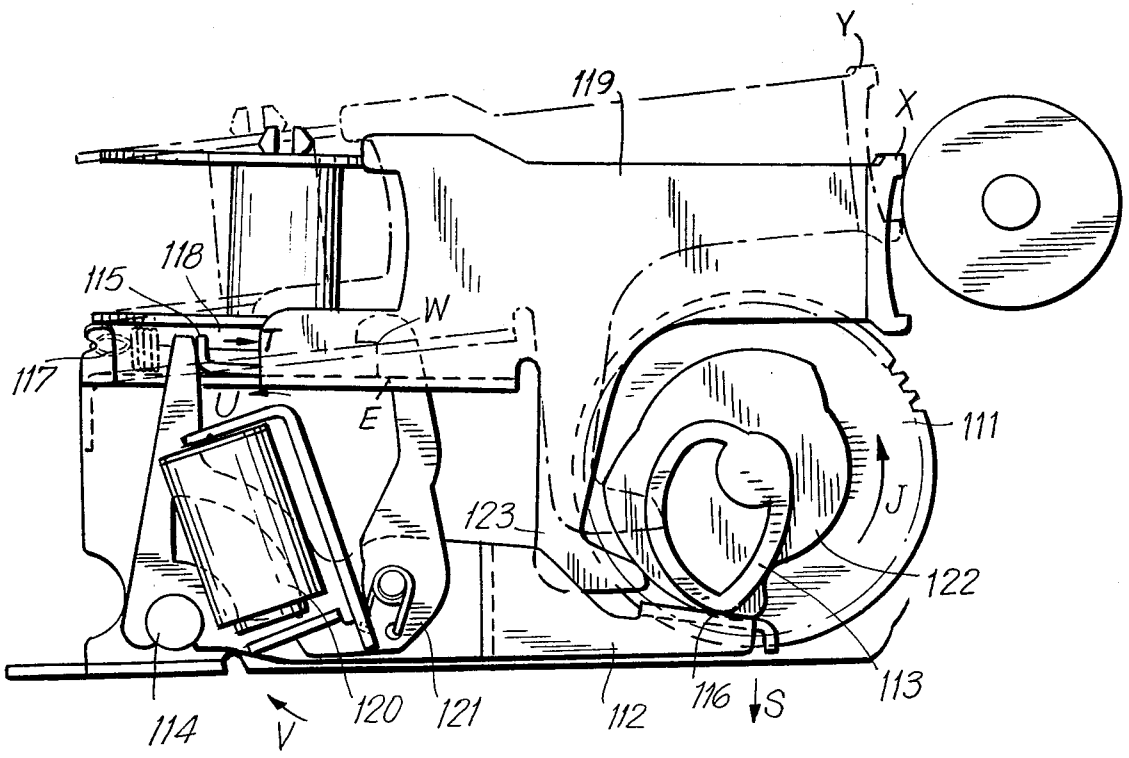
FIG. 18 illustrates the ink-ribbon selection mechanism in an embodiment of the present invention.

The ribbon mechanism is explained in connection with FIG. 18. In ordinary ribbon-feeding, a gear wheel 111 is arranged to rotate in the arrow J direction when the printer itself starts. A drive lever 112 is rotated on shaft 114 as a center in the arrow S direction by cam 113 mounted on gear wheel 111 until it is in contact with the cam 113 at its maximum diameter. By this movement, a feeding pawl 115 is shifted in the arrow T direction by drive lever 112. As the printer itself continues to move and the point of engagement between cam 113 and end 116 of drive lever 112 shifts from the maximum diameter to the minimum diameter of cam 113, feeding pawl 115 is also shifted in arrow U direction by means of spring 117 causing spool gear wheel 118 to turn in an amount proportional to the motion of feeding pawl 115. This spool gear wheel is arranged so that an ink ribbon can be set thereon for feeding of the ink ribbon.

Provision is also made for the changeover movement required for changing the color printed by a red-black ink ribbon. For printing as usual in black, a ribbon frame 119 is hooked by the E shoulder of shift lever 121 and maintained in the X state when no current is passed through ribbon-shift electromagnet 120. When it is desired to print in red, power is supplied to ribbon-shift electromagnet 120, shift lever 121 is attracted thereby and rotated in the arrow V direction. By this motion the ribbon frame 119 is released from engagement with the E shoulder and rises to the W shoulder by the force of a ribbon-shift spring (not shown) to place the ribbon frame 119 in the Y state for red printing.

The ribbon shift spring (not shown) continually biases the ribbon frame 119 upwardly whether it is printing in red or in black. The shifting from the X state for red printing to the Y state for black printing takes place when cam 122 on gear wheel 111 is automatically rotated at the completion of printing and depresses a lever 123 which is integral with ribbon frame 119, causing said ribbon frame to engage with the E shoulder of the shift lever 121. The shape of the cam 113 provided on gear wheel 111 is such that it will not suddenly shift the ribbon frame 119 when the ribbon frame 119 is to be placed in the Y state. Thus the cam shape is made in the form of a gentle curve so as to prevent an abrupt shifting of the ribbon frame, thereby avoiding any detachment of the ribbon or production of noise which could arise from sudden shifting of the ribbon frame.

Figure 19:
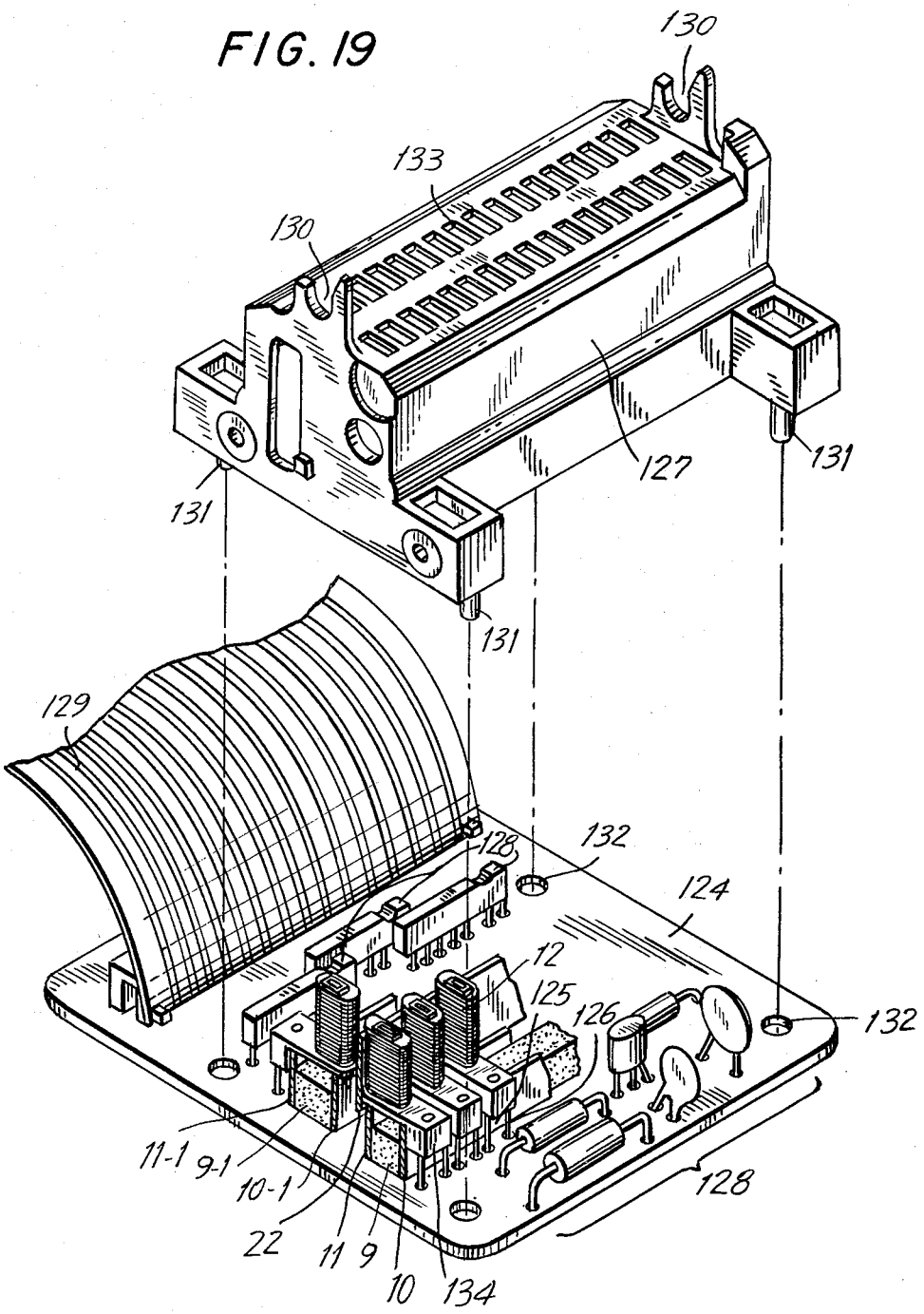
FIG. 19 is an oblique view showing how the electronic circuitry, the electromagnetic means and lead terminals and connections for wiring connections to the exterior of the miniature printer are arranged on a single base in unitary fashion in an embodiment of the present invention.

The arrangement of the detecting circuit, the electronic circuit which controls the electromagnetic components, the electronic components for selectively bringing the type wheels to a halt and the lead terminals and connections for electric wiring with external components are shown in FIG. 19, and, as can be seen, are arranged on a standard wiring-base plate. Electromagnet coil 12 is mounted on a coil frame 134 and legs 125 and 126 supported on base plate 124. Also, permanent magnets 9 and 9-1, magnetic plates 10 and 10-1, 11 and 11-1 and magnetic member 22 are built as a unit with the electromagnet coil 12 on the coil frame and legs in the trigger case 127. The trigger case 127 is fastened to wiring base plate 124 by inserting legs 131 into holes 132. Also, the electronic parts 128 for use with the printer and lead terminals or connectors 129 for wiring connections with external components and sources are arranged on the identical wiring base plate 124. On the magnetic means arranged on the identical wiring base plate 124 and constructed as a unit within the trigger case 127 are mounted the pawl member 17 and selecting pawl guide 32 also combined into a unit as shown in FIG. 19 by inserting the unitary pawl member 17 into the aperture 133 provided on trigger case 127 and shaft 19 is securely fixed on stationary support 130 of said trigger case 127. Considering that the means for bringing the rotatable character ring to rest is a unit, no adjustment is required at any point and assembling with ease is thereby rendered possible. The electronic components are arranged on the identical wiring base plate 124 as are control circuits for the motor which is a power source for the printer and electronic parts for detecting circuits which detect the face of the character ring 1. By arranging the electromagnetic coil of the electromagnetic means to be used for the printer, the control circuits for the motor which is a drive source for the printer, and the electric parts for detecting circuits to detect the phase of the character ring on the identical wiring base plate, soldering work can be finished in a single pass through dipping equipment, such a procedure being effective and reliable. Also, since wiring with actual wires is unnecessary, the number of process steps is reduced and wiring errors are completely eliminated. Also, the arrangement is advantageous with respect to miniaturization in terms of volume. Moreover, the wiring base plate located near the bottom of the printer makes it easy to check up on the electric operations of the wiring base plate and to replace any electronic parts which cause trouble. The above construction yields a rapid, reliable and quiet miniature printer which is of low cost and is easy to construct and to service.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A miniature printer, wherein character rings having characters on the outer peripheries thereof are rotatable from a standby position to bring a selected character to a printing position for printing said selected character in cooperation with a platen, and can be returned to said standby position, comprising for each character ring:

a pawl member for selectively bringing said character ring to rest at a printing position;

magnetic means including permanent magnet means and electromagnetic coil means for cooperatively establishing standby and selection positions in which said pawl member may be held in the absence of a current pulse through said coil means, and for transferring said pawl member from said standby to said selection position by passage of current through said coil means;

character signal means for providing a character signal for indicating the position of said character ring during rotation and during rest and when in a standby position;

detection means for receiving said character signal and for determining when said pawl member is to be activated and when printing is to be effected;

pawl shaft means on which said pawl member is mounted for rotation therearound; and wherein said pawl member includes a core member and a reset arm, said core member including first and second core arms;

said first core arm in part lying within said electromagnetic coil means and protruding therethough into the magnetic field of said permanent magnet means, said permanent magnet means being disposed relative to said first shaft mea .s and said coil means so that said first core member is positioned proximate one or the other of the poles of said permanent magnet means when said pawl member is disposed in standby or said selection position, said second core arm lying outside said electromagnetic coil means; said reset arm being arranged and disposed for mechanical reset of said pawl member from said selection to said standby position.

2. A miniature printer as defined in claim 1, further comprising paper-feeding means for introducing a web of recording paper between said characters and said platen and for removing said recording paper from between said characters and said platen; and pressing means for pressing said characters and said platen together with said printing paper therebetween.

3. A miniature printer as defined in claim 2, wherein said paper-feeding means includes a paper-feeding roller and an idler roller engageable with each other for feeding said web of recording paper, and further comprising releasing means for disengaging said idler roller from said paper-feeding roller; and ribbon transport means for passing printing ribbon between said character ring and said platen for printing on said recording paper.

4. A miniature printer as defined in claim 3, further comprising a support member for said idler roller, said support member being of one piece construction and including means for limiting the displacement of said idler roller in either axial direction; and spring means for biasing said idler roller against said paper-feeding roller.

5. A miniature printer as defined in claim 1, further comprising electronic circuitry means connected with said detection means for selectively activating said electromagnetic coil means and pawl member for bringing said character ring to rest with a selected character at a printing position, for activating said pressing means and for controlling said paper-feeding means and said ribbon transport means.

6. A miniature printer as defined in claim 1, wherein said magnet means further includes pole plates at each of the poles of said permanent magnet means.

7. A miniature printer as defined in claim 6, wherein at least one of said pole plates is apertured for receiving one of said core arms in said aperture when said pawl member is in one of said standby and selection positions, thereby eliminating the need for a spacer between said first core arm and said pole piece.

8. A miniature printer as defined in claim 1, wherein said electromagnetic coil means for said character rings are arranged alternately in two adjacent rows and further comprising a magnetic shield member between said rows positioned for confining the magnetic field generated by one row of said electromagnetic coil means to its corresponding pawl members, and for equalizing the current and power needed in different electromagnetic coil means.

9. A miniature printer as defined in claim 1, further comprising guide means for controlling the motion of said pawl member between said standby and selection positions and for pressing against said reset arm to reset said pawl member.

10. A miniature printer as defined in claim 9, wherein said pawl shaft means and said guide means are of non-magnetic material.

11. A miniature printer as defined in claim 1, wherein said character ring has a side face, and further comprising selecting teeth on said side face for coacting with said pawl member in selection of a character for printing.

12. A miniature printer as defined in claim 1, wherein said electromagnetic coil means are arranged in two rows, said second core arm of each pawl member lying between the coil means corresponding to the next adjacent pawl members.

13. A miniature printer as defined in claim 1, further comprising reciprocatingly rotatable ring shaft means for releasably rotating said character ring in a first direction into a printing position for a selected character and for returning said ring in reverse rotational direction to a standby position.

14. A miniature printer as defined in claim 1, wherein said character signal means comprises; a disc mounted for rotation on and with said ring shaft, said disc having angularly spaced-apart radial slots therein corresponding in angular position to characters on said character ring and a wide aperture corresponding in angular position to the standby position of said character ring;

light source means disposed for sending light through said slots and aperture and toward said detection means;

shutter means positioned for selectively intercepting the light from said light source means directed toward said detection means; and coupling means between said shutter means and said ring shaft for selectively interposing said shutter means between said light source means and said detection means.

15. A miniature printer as defined in claim 1, wherein said electronic circuitry is arranged and disposed for converting said character signals detected by said detection means into timing pulses and for selectively activating said pawl members, said pressing means and said paper-feeding means; and further comprising a case for containing said pawl member, said electromagnetic coil means and said permanent magnet means; and a base plate including wiring connections for mounting said case and contents thereof as a unit.

16. A miniature printer as defined in claim 15, wherein electronic components of said detecting means and control circuits are positioned on said base plate to form a portion of said unit.

* * * * *

UNITED STATES PATENT AND TRADEMARK OFFICE

CERTIFICATE OF CORRECTION

PATENT NO. : 4,244,290

DATED : January 13, 1981

INVENTOR(S) : KAZUTO TAMAI et al.

It is certified that error appears in the above—identified patent and that said Letters Patent is hereby corrected as shown below:

On the title page, item (73) should read

-- [73] Assignee: Kabushiki Kaisha Suwa Seikosha, Tokyo, Japan and Shinshu Seiki Kabushiki Kaisha, Nagano-ken, Japan --

-- [30] Foreign Application Priority Data

Mar. 29, 1977 Japan..... 52-35887 --

Signed and Sealed this

*Thirteenth* Day of *April 1982*

[SEAL]

*Attest:*

GERALD J. MOSSINGHOFF

*Attesting Officer*

*Commissioner of Patents and Trademarks*